United States Patent [19]

Uchida

[11] 4,257,208

[45] Mar. 24, 1981

[54] ROD FOR SUPPORTING ACCUMULATED COINS IN COIN PACKAGING MACHINE

[75] Inventor: Isamu Uchida, Tokyo, Japan

[73] Assignee: Laurel Bank Machine Co., Ltd., Tokyo, Japan

[21] Appl. No.: 70,057

[22] Filed: Aug. 27, 1979

Related U.S. Application Data

[63] Continuation of Ser. No. 859,464, Dec. 12, 1977, abandoned.

[30] Foreign Application Priority Data

Dec. 17, 1976 [JP] Japan ..... 51-168865

[51] Int. Cl.[3] ..... B65B 11/04

[52] U.S. Cl. ..... 53/212

[58] Field of Search ..... 53/211, 212, 213, 380; 133/1 A, 8 A

[56] References Cited

U.S. PATENT DOCUMENTS

| | | | |
|---|---|---|---|
| 3,775,940 | 12/1973 | Hatanaka | 53/212 |
| 3,882,659 | 5/1975 | Charlop | 133/1 A X |
| 3,938,303 | 2/1976 | Ushio et al. | 53/212 |
| 3,950,921 | 4/1976 | Itoda | 53/212 X |
| 4,038,806 | 8/1977 | Rothman et al. | 53/212 X |

*Primary Examiner*—John Sipos

*Attorney, Agent, or Firm*—Stevens, Davis, Miller & Mosher

[57] ABSTRACT

A coin packaging machine where a predetermined number of coins accumulated in columnar form in an accumulating cylinder are supported by a supporting rod. A packaging paper is wrapped around the periphery of the columnar assembly of accumulated coins and both ends of the paper are folded and clamped (per amendment) rod is used for supporting accumulated coins not only for guiding of the accumulated coins from the accumulating cylinder to the packaging zone but also supporting of the accumulated coins in the packaging zone during rotation of the accumulated coins. A concave groove for the insertion of a clamping claw is formed in the side face of said supporting rod.

4 Claims, 5 Drawing Figures

ROD FOR SUPPORTING ACCUMULATED COINS IN COIN PACKAGING MACHINE

This is a continuation of application Ser. No. 859,464, filed Dec. 12, 1977, now abandoned.

BACKGROUND OF THE INVENTION

The present invention relates to a rod for supporting accumulated coins in a coin packaging machine of the type in which a predetermined number of coins, ordinarily fifty, are stacked and accumulated in columnar form, a packaging paper is wrapped around the peripheral side surface of the columnar assembly of accumulated coins, and both the upper and lower ends of the paper around the columnar assembly of the accumulated coins are folded and clamped to package the coins.

In conventional packaging machines of this type, a supporting rod comprises a pipe-like supporting cylinder for supporting accumulated coins from below and guiding them to a packaging zone from an accumulating cylinder, and a holding lever fitted and inserted into the supporting cylinder. When coins are supported from below, it is preferred to use a supporting cylinder having a large diameter approximately equal to the coin diameter in order to support the coins stably. However, when both ends of a packaging paper wrapped around the coins are folded and clamped in the packaging zone, the employment of a supporting cylinder having such a large diameter makes it impossible to move a clamping claw to the clamping position. Accordingly, at the packaging position in the conventional packaging machines the supportng cylinder is brought down so that the top end of the holding lever in the supporting cylinder bears against the lower face of the accumulated coin assembly for the holding lever to support the accumulated coins, the supporting cylinder alone is lowered further, and then the clamping claw is moved to the clamping position. In short, in the conventional coin packaging machine, coins are guided and held independently by two different members.

Accordingly, both the guiding and holding members and the members which operate them are structurally complicated.

SUMMARY OF THE INVENTION

The present invention is characterized in that the structure is simplified so that coins are supported by one supporting rod not only during the stage of guiding coins to the packaging zone but also during the stage of packaging coins, and in that a concave groove is formed in the supporting rod so that the supporting rod does not hinder the movement of a clamping claw to the clamping position.

DETAILED DESCRIPTION OF THE PREFERRED EMBODIMENTS:

The present invention will now be described in detail with reference to embodiments illustrated in the accompanying drawings.

Figure 1:
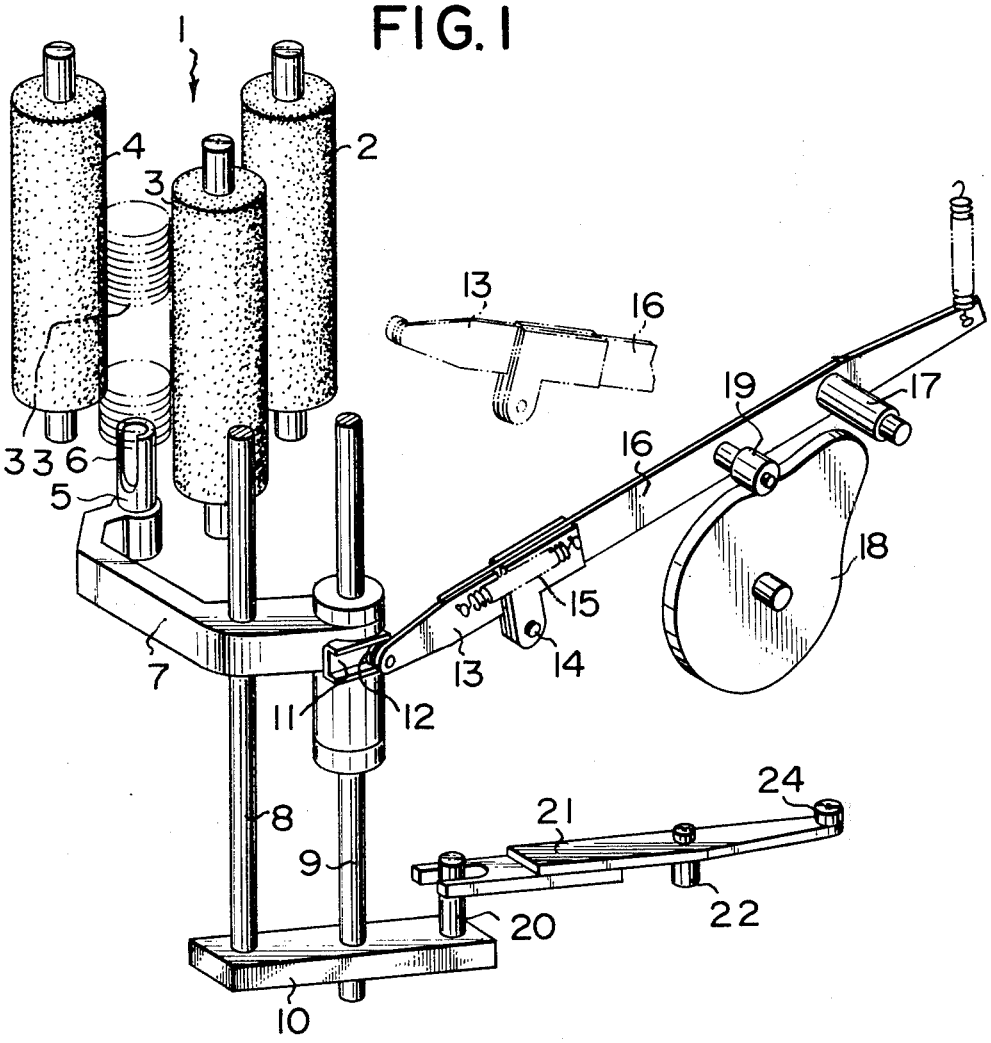
FIG. 1 is a perspective view showing the main part of a coin packaging machine comprising one embodiment of the supporting rod of the present invention.

Referring to FIG. 1, a packaging zone 1 includes packaging rollers 2, 3 and 4 for rotating a columnar assembly of accumulated coins while in contact with the periphery of the columnar assembly and wrapping a packaging paper around the columnar assembly of the coins. Reference numeral 5 represents a supporting rod according to the present invention, and in the embodiment illustrated in FIG. 1, the supporting rod 5 has a tubular or hollow cylindrical shape and a concave groove 6 open at the top end of the rod. The supporting rod 5 is attached to an arm 7 and is moved up and down while being guided by guiding shafts 8 and 9. When the supporting rod 5 is moved up, it is located at a position corresponding to the position of the lower end of an accumulating cylinder (not shown), and when the supporting rod 5 is moved down, it arrives at the lower portion of the packaging zone 1 as shown in FIG. 1. The guiding shaft 8 is fixed to a plate 10 and the guiding shaft 9 is freely fitted in the plate 10. The guiding shaft 9 passes through one end of the arm 7, and a roller guide 11 is attached to said one end of the arm 7. A roller 12 engaged with the roller guide 11 is attached to a joined arm 13 which is connected to an operating arm 16 through a pin 14 and a spring 15. The operating arm 16 swings in the vertical plane about a shaft 17 through a cam 18 and a cam roller 19 to move the arm 7 in the vertical direction. The arm 7, guiding shaft 8 and plate 10 are rotated about the guiding shaft 9. This rotation is accomplished by rotation of a shifting arm 21 engaged with an operating pin 20 with a central shaft 22 acting as the center of rotation. Rotation of the shifting arm 21 is performed through a cam 23 (see FIG. 2) and a cam roller 24.

Figure 2:
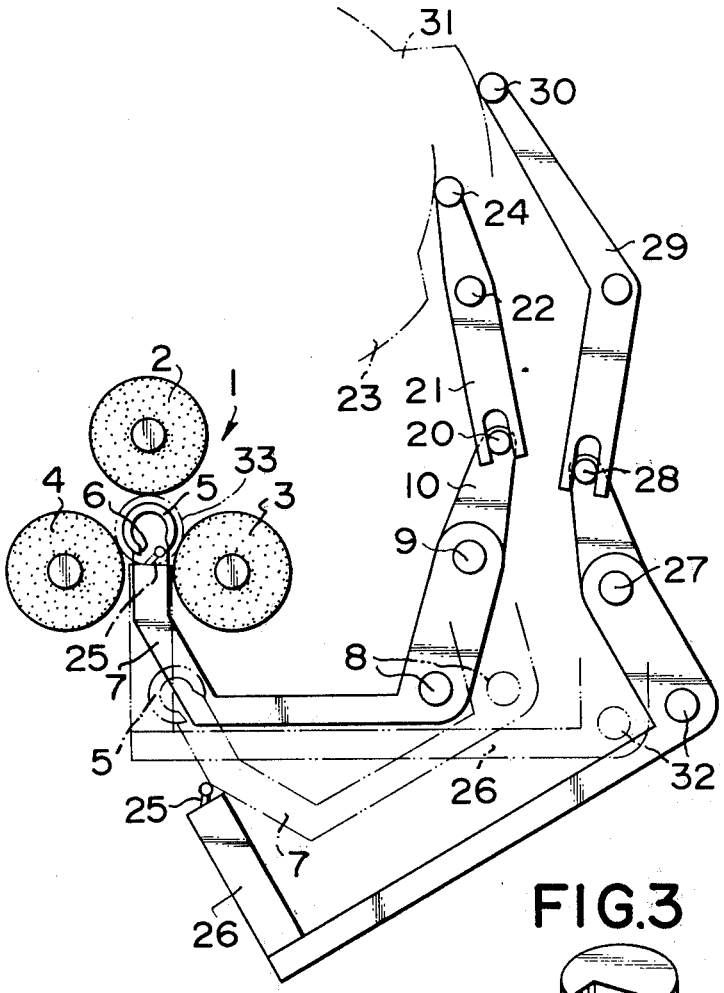
FIG. 2 is a plan view of the packaging machine shown in FIG. 1.

Referring now to FIG. 2, a clamping claw 25 is mounted on the top end of a holder 26. The holder 26 is turned in the horizontal direction by a cam 31 through a cam roller 30 of a lever 29 engaged with a pin 28, with a shaft 27 acting as the center of rotation. The holder 26 is also moved in the vertical direction by a mechanism (not shown) similar to the above-mentioned operating arm 16 while being guided by the shaft 27 and a guiding shaft 32.

Figure 3:
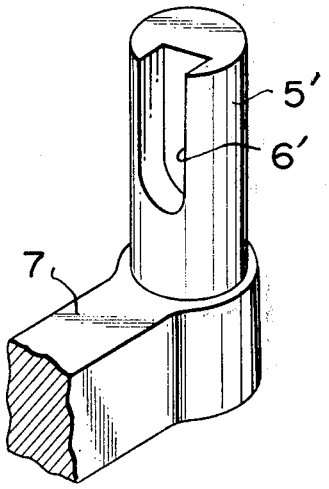
FIG. 3 is a perspective view illustrating another embodiment of the supporting rod of the present invention.

FIG. 3 is a perspective view illustrating a second embodiment of the supporting rod of the present invention. In this embodiment, a concave groove 6' is formed in a solid supporting rod 5'. Also in this case, the concave groove 6' is formed on the side face of the rod 5' and open at the top end, as shown in FIG. 3.

Figure 4:
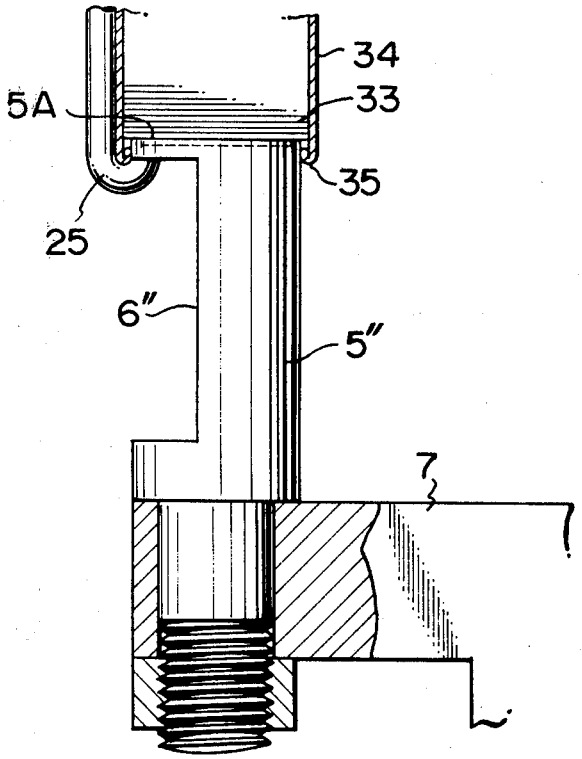
FIG. 4 is an elevational view of still another embodiment of the supporting rod of the present invention.
Figure 5:
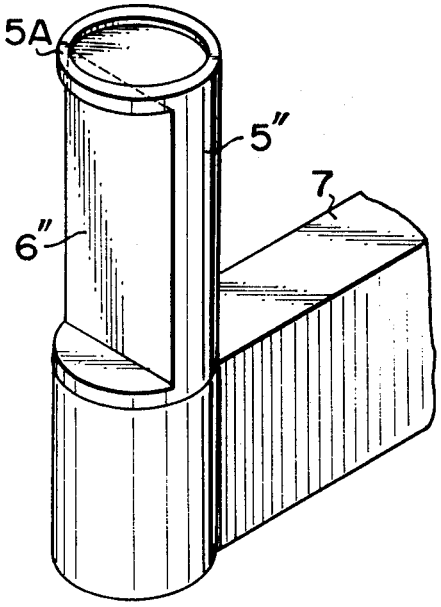
FIG. 5 is a perspective view of the supporting rod shown in FIG. 4.

FIGS. 4 and 5 are perspective view illustrating a third embodiment of the supporting rod of the present invention.

Referring to FIGS. 4 and 5, a supporting rod 5'' is fixed to an arm 7 and is operated by vertical movement and rotation of the arm 7. The top end face of the supporting rod 5'' acts as a supporting face 5A for accumulated coins 33, the face 5A preferably having a saucer-like configuration. The diameter of the supporting rod 5'' is determined so that after the paper 34 around accumulated coins 33 is folded and clamped by both ends, the packaged coins 33 can readily be withdrawn from the supporting rod 5''.

In the present invention, a notch 6″ having depth and length sufficient to allow the clamping claw 25 to intrude to the side face of the supporting rod 5″ while not hindering the vertical movement thereof is formed in the side face of the supporting rod 5″, the supporting face 5A having such thickness as will not hinder clamping 35 of the packaged coins.

In the embodiment having the above-mentioned structure, coins are stably supported since a sufficiently large supporting area can be obtained.

Even if clamping action does not sufficiently reach the coin face because of the presence of the supporting face, no particularly disadvantage occurs in actual use. On the contrary, some latitude between coins facilitates the breaking of the package because the columnar assembly of the coins are readily be broken open by fingers without hitting it against an object.

The operation of a coin packaging machine including the supporting rod 5, 5′ or 5″ of the present invention having the above-mentioned structure will now be described with reference to FIGS. 1 and 2.

Referring to FIG. 1, the operating arm 16 is operated by the cam 18 to raise the arm 7 through the joined arm 13 while being guided by the guiding shafts 8 and 9, whereby the arm 7 is made to approach the bottom plate of an accumulating cylinder (not shown) in which a predetermined number of coins are accumulated. At this point, the bottom plate of the accumulating cylinder is opened and the accumulated coins are supported by the supporting rod 5. Then, the cam 18 is rotated to bring down the arm 7, causing the supporting rod 5 to guide the accumulated coins to the packaging zone 1.

In the packaging zone 1, one or two of the packaging rollers 2, 3 and 4 approach the accumulated coins 33 and come in contact with the peripheral surface of the columnar assembly of the accumulated coins 33. The columnar assembly of the accumulated coins is rotated by said rollers and a packaging paper (not shown) is fed between the coins and the rollers, thereafter the packaging paper is wrapped around the coins in a known manner. Then, rotation of the cam 31 allows the lever 29 and holder 26 to move the clamping claw 25 about shaft 27 in the horizontal direction from the position indicated by a solid line in FIG. 2 to the clamping position indicated by a chain line. At this point, the clamping claw 25 is fitted in the concave groove or notch 6, 6′ or 6″ and moves without obstruction. Next, the clamping claw 25 is moved vertically while guided by the shaft 27 and guiding shaft 32. Means for moving the clamping claw 25 in the horizontal and vertical directions is also disposed in the upper portion of the packaging zone 1, the horizontal and vertical movement of the clamping claw 25 being performed symmetrically in both the upper and lower portions.

Thus, both bulged ends of the columnar assembly of the accumulated coins 33 are pressed and clamped by the clamping claw 25.

When packaging is thus completed, the holder 26 is returned to the original position indicated by the solid line in FIG. 2 from the position indicated by the chain line, the arm 7 is returned to the original position indicated by the chain line in FIG. 2 from the position indicated by the solid line, and the packaged coins 33 are allowed to drop and be removed by separation of the packaging rollers 2, 3 and 4.

As will be apparent from the foregoing illustration, the present invention provides a simplified structure since guiding and supporting of accumulated coins during the packaging operation are accomplished by one supporting rod having a concave groove or notch. Further, since the supporting face of the supporting rod can be expanded to an allowable maximum area within a range allowing clamping of a minimum size of coins, accumulated coins can be supported more assuredly and stably than in conventional supporting means where even large coins are supported by a holding lever having a small supporting face. Accordingly, occurrence of such undesirable phenomena as the collapse of coins accumulated and stacked in a columnar shape can be effectively prevented.

What is claimed is:

1. A coin packaging machine for wrapping a predetermined number of vertically stacked coins, said machine comprising:

an accumulating cylinder for holding coins in columnar form;

means for wrapping paper around a column of coins, said wrapping means comprising three rollers each rotatable about a substantially vertical axis, each of the three rollers being spaced apart from the other two to define a packaging zone for the stacked coins between the three rollers;

a first rigid arm, one end of said arm being pivotable substantially horizontally about a substantially vertical axis at the other end thereof into and out of the space between two of said rollers and being vertically movable along said axis;

means to pivot said first rigid arm about said substantially vertical axis;

means to move said first rigid arm vertically along said substantially vertical axis;

a single rod for soley supporting accumulated coins from below, said rod having a single planar upper end surface on which accumulated coins can rest, said planar upper end surface engaging the lower surface of the bottom most one of the smallest diameter coins the machine can handle close to the periphery of the bottom most one of the smallest coins at a plurality of circumferentially spaced points said supporting rod guiding the accumulated coins from the accumulating cylinder to the packaging zone with the accumulated coins resting solely on the upper end surface of the rod and also supporting the accumulated coins, solely on the upper end surface, in the packaging zone during wrapping, folding, and crimping the lateral edges of the wrapping paper over the ends of the accumulated coins, said rod being fixedly secured to the upper side of the one end of said arm, being pivotable with said arm into and out of the packaging zone through the space between said two rollers and being vertically movable with said arm in the packaging zone, means defining a vertically extending groove in the rod which opens outwardly in the direction of the space between the two of said rollers;

a second rigid arm, one end of said second arm being pivotable substantially horizontally about a substantially vertical axis at the other end thereof into and out of the space between the two of said rollers and being vertically movable along said last-mentioned vertical axis;

means to pivot said second rigid arm about said last-mentioned substantially vertical axis;

means to move said second rigid arm vertically along said last-mentioned substantially vertical axis; and a clamping claw for folding and crimping the lateral edges of the wrapping paper over the ends of column of coins supported on the upper end surface of said rod, said claw being fixedly secured to said one end of said second arm, being pivotable into and out of the groove in the rod as said second arm pivots into and out of the packaging zone and being vertically movable with said second arm.

2. A machine as claimed in claim 1, wherein:

said supporting rod comprises a hollow cylindrical member and the groove opens into the top of the rod.

3. A machine as claimed in claim 1, wherein:

said supporting rod is tubular and the groove opens into the top of the rod.

4. A machine as claimed in claim 1, wherein:

said supporting rod is solid and the groove opens into the top of the rod.

* * * * *